US005449006A

United States Patent [19]

Hogan et al.

[11] Patent Number: 5,449,006

[45] Date of Patent: * Sep. 12, 1995

[54] HAIR TREATMENT APPLIANCE

[75] Inventors: Gary L. Hogan, Leesville, S.C.; Kathryn B. Park, Palm Beach Gardens, Fla.

[73] Assignee: KB Marketing, Inc., Roswell, Ga.

[ * ] Notice: The portion of the term of this patent subsequent to Mar. 16, 2010 has been disclaimed.

[21] Appl. No.: 32,534

[22] Filed: Mar. 15, 1993

Related U.S. Application Data

[63] Continuation-in-part of Ser. No. 808,433, Dec. 16, 1991, Pat. No. 5,193,557.

[51] Int. Cl.[6] ..... A45D 24/22

[52] U.S. Cl. ..... 132/112; 132/148

[58] Field of Search ..... 132/112, 148, 126, 147, 132/154, 152, 139, 121; 222/402.1, 402.15

[56] References Cited

U.S. PATENT DOCUMENTS

| | | | |
|---|---|---|---|
| 2,218,471 | 10/1940 | Hickey | 132/112 X |
| 3,192,934 | 7/1965 | Catania | 132/139 X |
| 3,516,424 | 6/1970 | Eagle | 132/148 |
| 3,960,160 | 6/1976 | Hogan | 132/112 |
| 4,934,855 | 6/1990 | Recchelbacher | 132/148 X |
| 5,193,557 | 3/1993 | Hogan | 132/148 X |
| 5,242,090 | 9/1993 | Reyss | 222/402.15 X |

*Primary Examiner*—Gene Mancene
*Assistant Examiner*—Jeffrey A. Smith
*Attorney, Agent, or Firm*—Malin, Haley, DiMaggio & Crosby

[57] ABSTRACT

A hair treatment appliance having improved dispensing capable of multi-faceted operation in the care and treatment of human hair. A body is provided having generally a hollow chamber therein to receive an aerosol container. An opening in a wall of the chamber permits a dispensing valve of the aerosol container residing therein to dispense the contents of the container therethrough. A comb is secured to an end of the body and extends outwardly therefrom, with an optional brush attachment removably secured thereto, while at the opposite end, hair lifters, which are a plurality of spaced apart elongated members, are optionally provided. A cap is generally provided adjacent one end of the hollow body and acts as a closure for the hollow chamber that receives the aerosol container. The aerosol container is actuated by a linear moving trigger secured to the body on the opposite side of the opening.

16 Claims, 5 Drawing Sheets

Fig. 13
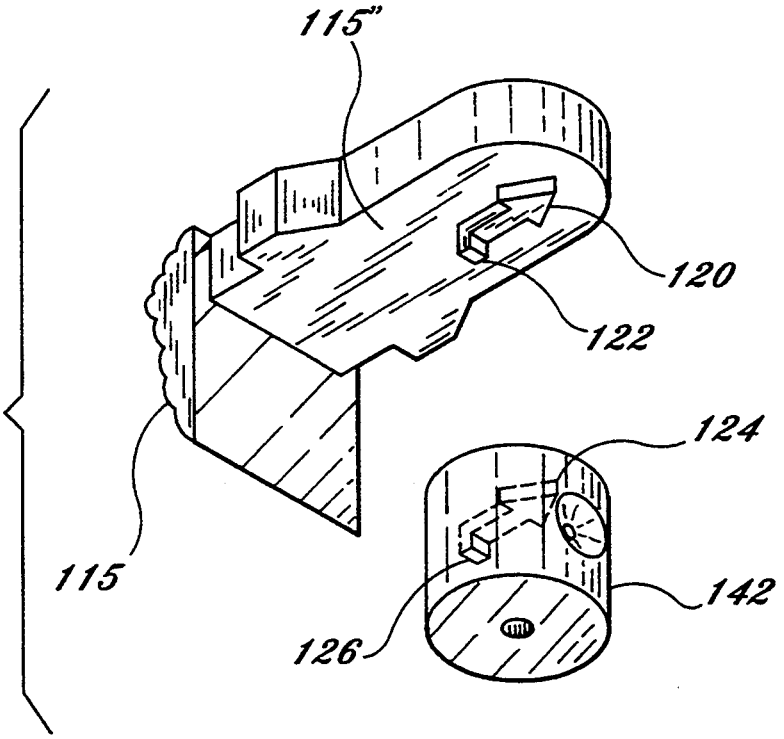
Fig. 14
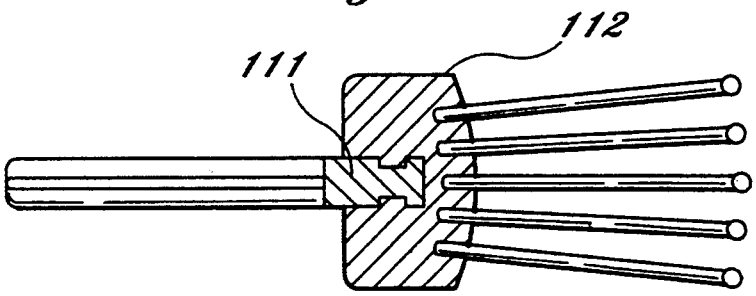
Fig. 15
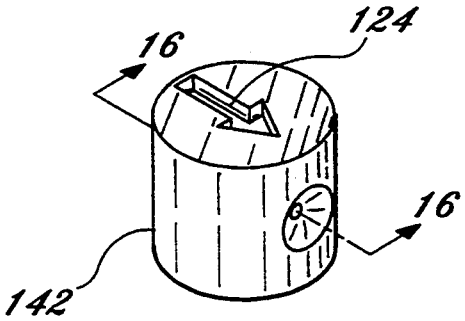
Fig. 15
Fig. 16
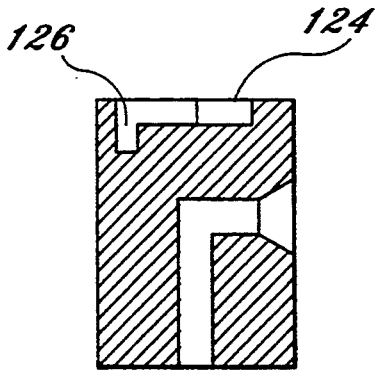

HAIR TREATMENT APPLIANCE

This is a continuation-in-part of application Ser. No. 07/808,433 filed Dec. 16, 1991, issued as U.S. Pat. No. 5,193,557 on Mar. 16, 1993.

BACKGROUND OF THE INVENTION

1. Field of the Invention

The present invention relates generally to a hair treatment appliance and more particularly to a comb and hair spray container/dispenser combination having an improved dispensing trigger and reusable aerosol hair spray container housing to prevent nozzle rotation.

2. Background of the Invention

A device that employs a comb in combination with a hair spray dispenser is known in the art. U.S. Pat. No. 3,960,160, issued to Applicant, discloses a hair treatment appliance capable of multi-faceted operation such as combing and applying hair spray. However, the aerosol spray container used in conjunction with the device has been known to turn, and thus become misaligned with the opening used for exiting the aerosol spray, due to the rotational forces applied when utilizing the trigger mechanism taught in U.S. Pat. No. 3,960,160. Additionally, the trigger design of U.S. Pat. No. 3,960,160 has been known to bend the valve stem associated with the trigger. The present invention overcomes these problems by providing a hair treatment appliance having an improved trigger system and container mount which prevents the aerosol spray container from turning when the user activates a trigger to discharge aerosol spray. Additionally, the improved trigger system can not bend the container valve stem. The present invention also provides for a trigger mechanism on the spray dispenser that prevents the dispenser from being accidentally activated. Also, the improved trigger mechanism prevents any spray from being dispensed from inside a blister pack package caused by accidental pressing on the blister pack.

However, the aerosol spray container used in conjunction with the device disclosed in U.S. Pat. No. 5,193,557 has also been known to turn, and thus become misaligned with the opening used for exiting the aerosol spray, again due to the rotational forces applied when utilizing the trigger mechanism taught in U.S. Pat. No. 5,193,557. The alternate embodiment of the present invention overcomes these problems by providing a hair treatment appliance having an improved trigger system and container mount which prevents the aerosol container from turning when the user activates the trigger to discharge aerosol spray. The present invention further provides a brush attachment which easily clips to the back of the comb, and an improved closure cap which applies pressure against the lower end of an aerosol container, and which stores an adapter for easily refilling the aerosol spray container with the user's favorite hair conditioning material.

SUMMARY OF THE INVENTION

The hair treatment appliance of the present invention preferably embodies three features, namely, a comb, a refillable aerosol container and a hair lifter device. All three of these elements in combination may be afforded on a single, compact appliance to permit hair to be properly cared for and/or manipulated by a stylist or a consumer.

The removable aerosol container is preferably received in a hollow chamber that extends axially along the body of the appliance. Preferably, the container is refillable and is guided into the hollow chamber of the body to facilitate alignment between the dispensing nozzle and the slotted opening. Spring means received in the closure cap is also provided to apply pressure against the lower end of the aerosol container and thus insure that the dispensing nozzle is held in the proper position.

In an alternate embodiment, a lateral engaging means is used in lieu of the spring means in the closure cap to apply pressure against the lower end of the aerosol container. The lateral engaging means is sized and positioned such that it applies pressure against the lower end of the aerosol container and thus insures that the dispensing nozzle is held in the proper position. Once the aerosol container is in position, a finger trigger essentially engages the upper side of the dispensing nozzle, as discussed below.

The trigger extends through the body by a trigger opening in the body. The trigger contains at least one flange member extending outwardly from the trigger. A slot within the body is located at the trigger opening to receive the flange member and to prevent the trigger from being removed out of the trigger opening. The slot along with the flange member combine to also prevent the trigger from pivoting. However, the trigger is allowed to move in a straight up and down direction, and when depressed, actuates the nozzle and dispenses the contents of the spray container.

The dispensing nozzle has at least one flat side which is in mesh relationship with a flat member molded to the interior of the body and extending inwardly towards the hollow chamber. This mesh relationship between the flat side and flat member prevents the nozzle from turning when the trigger is pressed. Once the aerosol container is spent, the closure cap can be removed and the container withdrawn for refilling or replacement.

In an alternate embodiment, the dispensing valve has a notch or groove in its upper surface which is mated with a correspondingly shaped protrusion on the bottom surface of the trigger. Thus, the dispensing valve and nozzle are prevented from turning when the trigger is pressed. The groove serves an additional purpose in that it allows the user a foolproof method of aligning the aerosol spray container with the opening used for exiting the aerosol spray.

From the standpoint of the comb feature, embodiments are presented wherein the teeth of the comb are alternately long and short to assist in proper handling of the hair and also of particular geometrical configuration. Moreover, while generally speaking, the comb extends axially outwardly from the appliance along a center line through the body, it is also an advantage and thus a further embodiment of the present invention to offset the comb to the outer edge of the appliance body.

In an alternate embodiment, a hair brush attachment is provided which is slidably engaged with the comb section.

A hair lifter, which includes a plurality of spaced apart elongated metal or plastic elements, is secured to the closure cap and extends outwardly therefrom so as to provide the multi-faceted hair treating appliance.

A removable adapter is secured within the closure cap to facilitate the refilling of the aerosol container with the user's favorite hair conditioning material.

It is an object of the present invention to provide an improved hair treatment appliance.

It is another object of the present invention to provide an improved hair treatment appliance which is a combination appliance for the treatment of hair wherein a hair conditioning material container is housed in a body that also provides a comb and, optionally, hair lifters or a brush.

It is yet another object of the present invention to provide an improved, compact hair treatment appliance.

It is still another object of the present invention to provide an improved hair treatment appliance which has an improved trigger mechanism to prevent bending of an associated valve stem.

It is a further object of the present invention to provide an improved hair treatment appliance which will not turn an associated aerosol spray nozzle when discharging aerosol spray.

It is still further an object of the present invention to provide an improved hair treatment appliance which is relatively low in cost and easy to manufacture.

BRIEF DESCRIPTION OF THE DRAWINGS

FIG. 13 is an exploded isometric view of an alternate embodiment of the trigger and valve of the present invention.

FIG. 14 is a cross sectional view taken along line 14—14 of FIG. 10.

FIG. 15 is a view in perspective of an alternate embodiment of the valve of the present invention.

FIG. 16 is a cross sectional view taken along line 16—16 of FIG. 15.

DESCRIPTION OF THE PREFERRED EMBODIMENT

Figure 1:
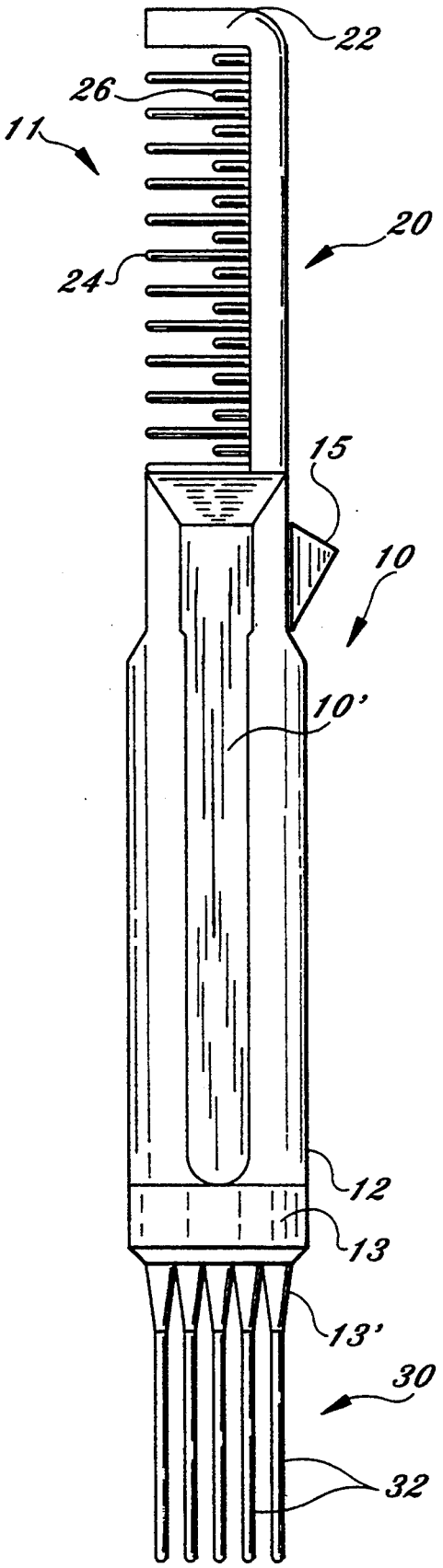
FIG. 1 is a side elevational view of a hair treating appliance according to the present invention.
Figure 2:
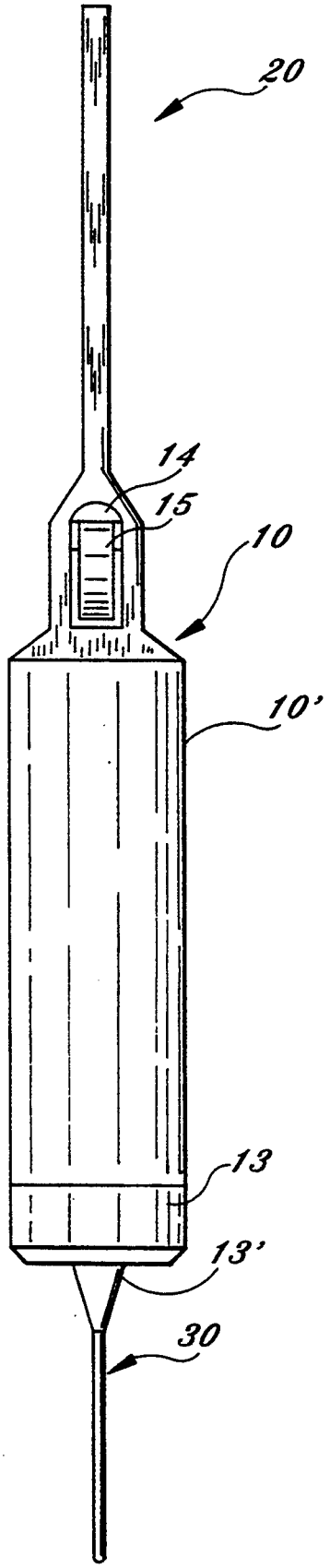
FIG. 2 is a rear view of the appliance as shown in FIG. 1.
Figure 3:
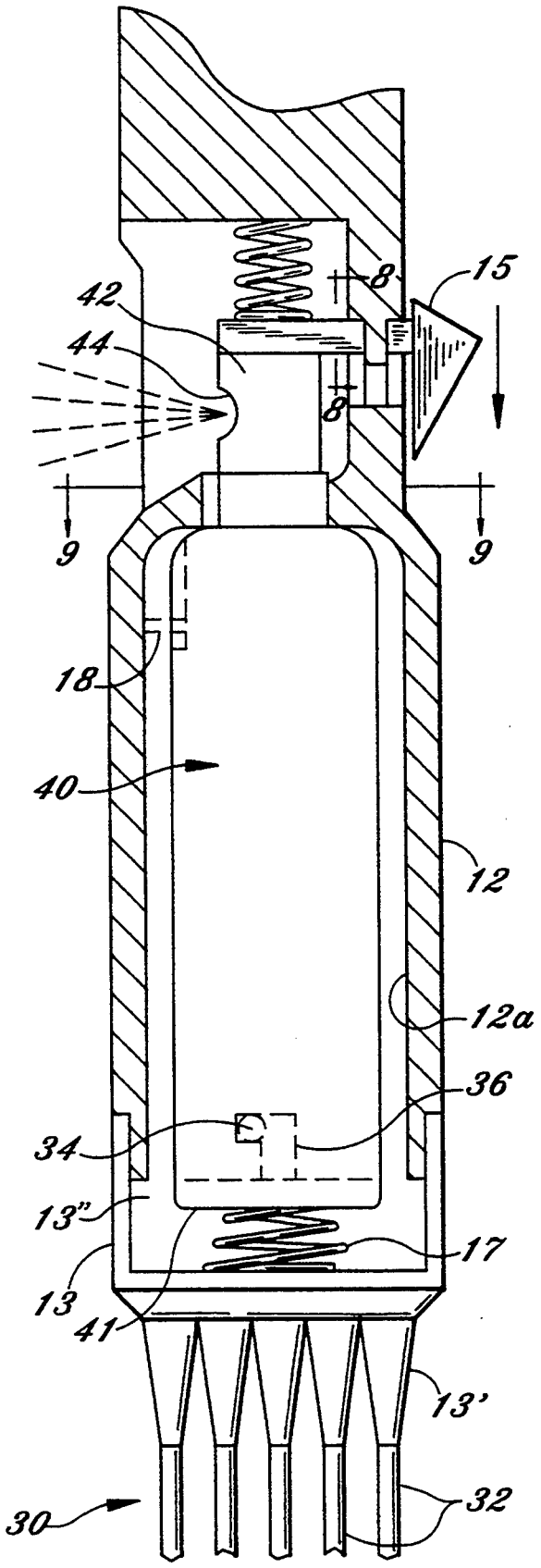
FIG. 3 is a partial cross sectional view of the hair treating appliance according to the teachings of the present invention.
Figure 4:
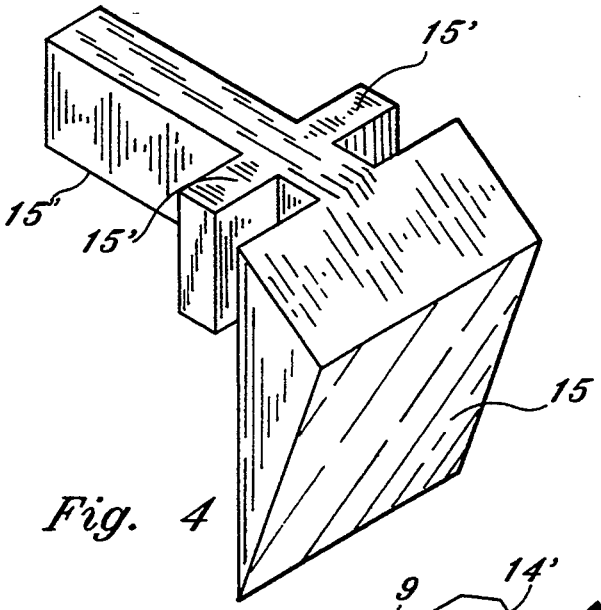
FIG. 4 is a perspective view of the improved trigger according to the teachings of the present invention.
Figure 5:
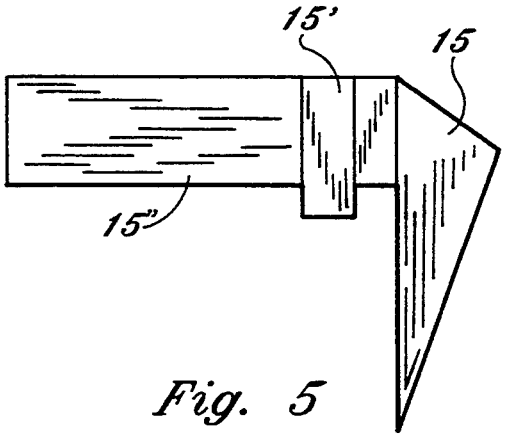
FIG. 5 is a side view of the trigger as shown in FIG. 4.
Figure 7:
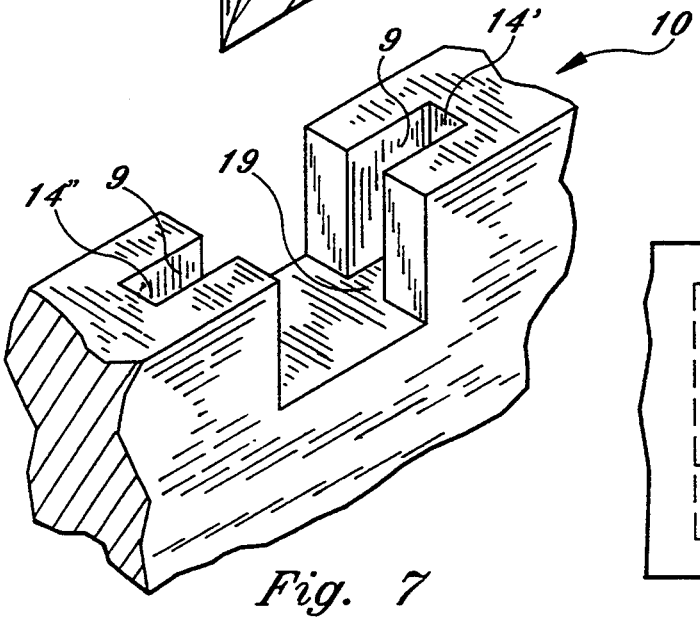
FIG. 7 is a perspective view of the trigger opening of the hair treating appliance according to the teachings of present invention.

Referring to the drawings, the preferred embodiment of the present invention will now be described in detail. In FIGS. 1 through 3, the hair treating appliance of the present invention is shown generally at 10 having a cylindrical body 12 with narrow teeth 11 forming a comb section 20 secured thereto and extending upwardly therefrom in an axial direction generally along the center line of body 12. A hair lifter element generally indicated as 30 having long then rigid teeth 32 is shown at an opposite end of body 10. Body 12 is elongated and has a hollow inside chamber **12*a* one end of chamber 12*a* having a closure cap 13 secured by an interlock in suitable fashion. Body 12 further has a dispensing slot opening 14 to permit aerosol hair spray to be dispensed, and an opposite trigger opening 14'. A trigger 15 is suitably received in trigger opening 14' adjacent hollow chamber 12*a* of body 12 and is held within body 12 and opening 14' by slot 9 of inner periphery 14" in a manner which will be described hereinafter. As illustrated in FIG. 1, the exterior of body 10 may be provided with suitable flat surface areas 10' or the like to suitably conform the body 12** to the user's hand, and thus afford a better and more comfortable fit.

Comb section 20 as shown in FIG. 1 extends outwardly from body 12 along a central longitudinal axis therethrough and comprises a rigid unitarily formed backbone 22 having a plurality of teeth 24 and 26 extending outwardly in a plane therefrom in a direction transverse to the elongated direction of body 12. As can be seen in FIG. 1, long teeth 24 and short teeth 26 alternate along the length of backbone 22 to afford an improved tooth arrangement for the comb.

Figure 10:
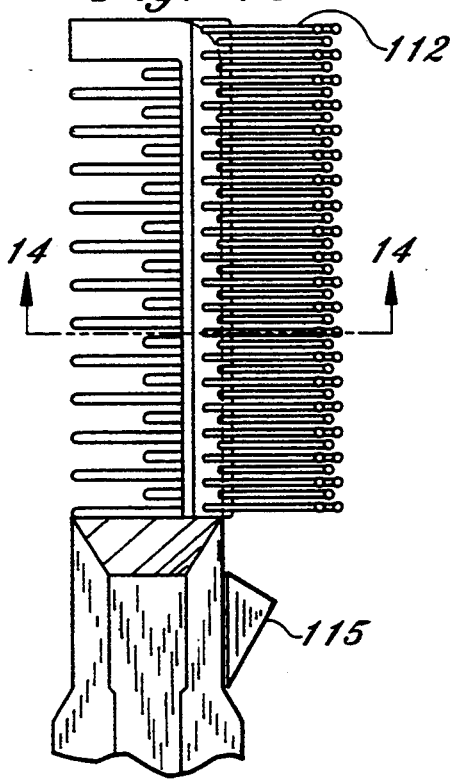
FIG. 10 is a partial side elevational view of an alternate embodiment, showing the brush attachment of the present invention.
Figure 11:
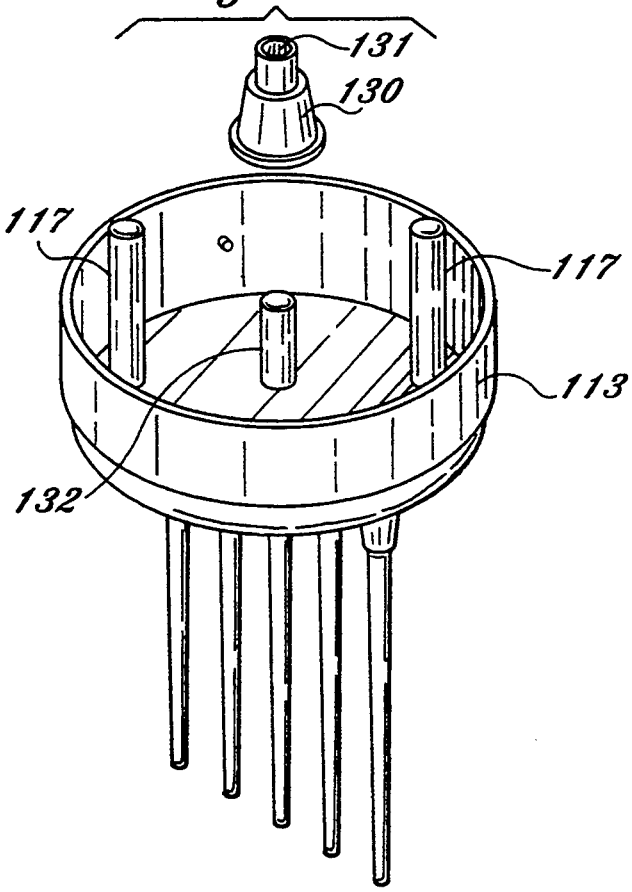
FIG. 11 is an exploded isometric view of an alternate embodiment of the closure cap of the present invention.
Figure 12:
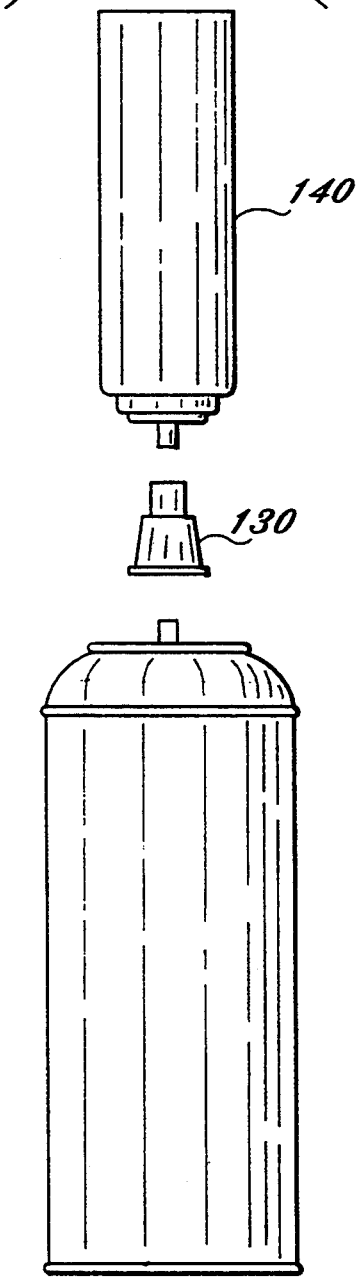
FIG. 12 is an exploded side elevational view showing the refillable characteristics of the aerosol container of the present invention.

In an alternate embodiment as seen in FIGS. 10 and 14, backbone 22 (FIG. 1) has a groove 111 along its length wherein brush attachment 112 may be slidably attached to backbone 22, thereby affording a user the option of using either a comb or a brush to style and touch up hair.

At an opposite end of body 10 secured to closure 13 are a plurality of lifter members 32 that define hair lifter element 30. Lifter members 32 are preferably elongated metal rods that are secured to surrounding plastic ferrule-like sections 13' that protrude from end closure 13. Hair lifter members may also be produced from a plastic material, though metal is preferred due to the fact that the metal elements are more durable and may be thinner to better penetrate the hair.

Closure 13 may be secured to body 10 in any suitable fashion. For example, FIG. 3 illustrates a pin-slot arrangement. A pin 34 is secured to a portion of body 12 that receives cap 13. A mating slot 36 is provided on the inner periphery 13" of closure 13. In suitable fashion, slot 36 extends spirally around the inner periphery 13" of closure 13 so as to permit a lock upon turning closure 13 therearound with pin 34 passing therealong.

A small aerosol container 40 is shown received in chamber **12*a* of body 12 in FIG. 3. Closure cap 13 received over the lower end thereof holds container 40 within compartment 12*a* and spring 17 received within cap 13 applies spring tension against container 40. Aerosol container 40 has a dispensing valve 42 secured at one end thereof with a nozzle 44 in alignment with opening or slot 14 of body 12. Coil spring 17 is secured within closure 13 and applies spring tension against a lower end of aerosol container 40, whereby dispensing valve 42 is held in contact with a trigger 15. A pin 18 can be provided within chamber 12*a* and extending inwardly against an outer grooved surface of container 40 as shown in phantom, for aligning container 40 within body 12**.

As seen in FIGS. 3–7, a finger activated trigger 15 is provided for the appliance and upon longitudinal movement thereof, an underside rigid flat surface 15″ forces dispensing valve 42 downwardly and provides an aerosol spray of the contents from container 40 to exit through nozzle 44 and slot 14 of body 12. Trigger 15 contains flange members 15′ extending outward from and perpendicular to trigger 15. Trigger 15 is secured within body 10 and trigger opening 14′ by flange members 15′ cooperating with slot 9. Before attaching comb 20 to body 10, trigger 15 is placed within trigger opening 14′ of body 10, which allows flange members 15′ to be aligned within and received by their respective slots 9. Before inserting aerosol container 40 within chamber **12*a*, trigger 15 rests along ledge 19 of body 10. After attaching comb 20 to body 10, trigger 15 is prevented from being removed from trigger opening 14′ by the combination of flange members 15′ located within slots 9. In addition, trigger 15 is also prevented from rotating by flange members 15′ and slots 9. However, trigger 15 can move in a straight up and down direction within trigger opening 14′ as flange members 15′ are able to move in a straight up and down direction within slots 9. Thus, trigger 15** can not pivot.

Preferably, aerosol container 40 is refillable by removal of the dispensing valve 42 after which additional material (hair spray) may be placed within container 40 suitable for aerosol dispensing. The refillable characteristics of the container 40, however, does not form a structural feature of the present invention, per se. Hence, particular details of structure of the container so as to facilitate refilling are not believed to be necessary, since such details are well within the purview of those skilled in the art.

Container 40 is aligned to insure that dispensing valve 42 and nozzle 44 are adjacent slot 14 for dispensing therethrough.

Figure 8:
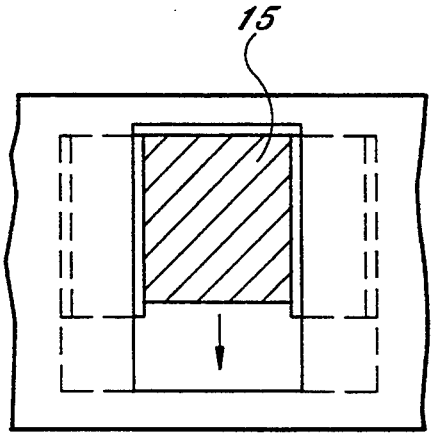
FIG. 8 is a partial cross sectional view taken along line 5—5 of FIG. 3.
Figure 9:
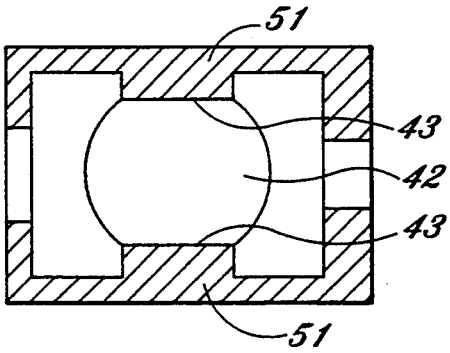
FIG. 9 is a cross sectional view taken along line 9—9 of FIG. 3.
Figure 6:
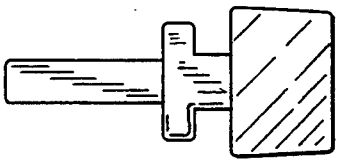
FIG. 6 is a top view of the trigger as shown in FIGS. 4 and 5.

As seen in FIGS. 8 and 9, to prevent valve 42 and nozzle 44 from turning when trigger 15 is pressed, at least one flat member 51 is molded to body 10. As seen in FIGS. 8 and 9, dispensing valve 42 has at least one flat side 43. Side 43 and flat member 51 fits adjacent and mesh to each other in order to prevent valve 42 from turning. Preferably, valve 42 has two flat sides 43 in mesh relationship with two molded flat members 51. Thus, misalignment and/or the necessity of manual alignment is avoided.

In an alternate embodiment, as seen in FIGS. 10–16, closure cap 113 received over the lower end of body 12 (FIG. 3) thereof holds container 140 within compartment **12*a* (FIG. 3) and lateral engaging members 117 connected within cap 113 apply pressure against the lower end of container 140, whereby dispensing valve 142 is held in contact with trigger 115. Closure 113 may be secured to body 10 (FIG. 3**) in any suitable fashion as described above.

In an alternate embodiment as seen in FIGS. 10–16, finger activated trigger 115 is provided with protrusion 120 on an underside surface 115″ with protrusion 120 having a nub 122 at its distal end. Dispensing valve 142 has a groove 124 in its upper surface (shown in phantom in FIG. 13), with groove 124 having a recess or slot 126 at its distal end. Protrusion 120 and groove 124 are correspondingly shaped, such that when aerosol container 40 (FIG. 3) is placed within compartment **12*a* (FIG. 3), dispensing valve 142 is mated with trigger 115, wherein protrusion 120 fits snugly into groove 124, with nub 122 fitting into slot 126, thus preventing the aerosol container from turning when the user activates trigger 115. Trigger 115 is secured within body 10 (FIGS. 3–7**) as described above.

As seen in FIGS. 10–16, an adapter 130 is removably stored in closure cap 113 by engaging end 131 over post 132 to facilitate the refilling of aerosol container 140 with a user's favorite hair conditioning material.

With the improved trigger mechanism and container housing, the reliability and accuracy of dispensing hair spray is greatly improved.

While the instant invention has been described in what is considered to be the preferred embodiment, it is to be understood that these descriptions are given by means of example only, and not by means of limitation. It is to understood that changes and modifications may be made to the description given and still be within the scope of the invention. Further, it is clear that obvious changes and modifications will occur to those skilled in the art.

What we claim is:

1. A hair treatment appliance comprising:

an elongated body having a hollow chamber, said elongated body having a proximal and distal end, said body having a pair of oppositely positioned openings near said proximal end;

trigger means moving along said body, a portion of said trigger means extending outwardly through a first of said pair of openings in said body;

an aerosol container disposed in said chamber, said container having a dispensing valve engageable with said trigger means, said valve being directed towards a second of said pair of openings in said body to expel an aerosol spray through said second opening when said trigger means is depressed;

a closure cap securable at said distal end of said body, said closure cap having means for providing lateral support to said aerosol container therein;

means for securing said trigger means within said first of said pair of openings in said body and for preventing said trigger means from pivoting when said trigger means is depressed;

means for preventing said valve from turning when said trigger means is depressed; and comb means secured to said proximal end of said elongated body and extending outwardly therefrom.

2. The hair treatment appliance of claim 1, wherein said closure cap further includes a plurality of elongated hair lifter elements secured thereto and extending outwardly therefrom in a generally parallel arrangement to said comb means.

3. The hair treatment appliance of claim 1, further including at least one flange member depending outwardly from and substantially perpendicular to said trigger means.

4. The hair treatment appliance of claim 3, wherein said means for securing is at least one slot in said body at said first opening, wherein said flange member is received within said slot to secure said trigger means within said first opening, said slot and said flange member preventing said trigger means from pivoting around said valve.

5. The hair treatment appliance of claim 1, wherein said means for preventing comprises a protrusion on an underside surface of said trigger, said protrusion having a proximal and distal end, said protrusion having a nub at said distal end, said means for preventing further comprising a groove in an upper surface of said dispensing valve, said groove having a proximal and distal end, said groove having a recess at its distal end, said protrusion and said groove being correspondingly shaped such that when said aerosol container is placed within said chamber, said dispensing valve is interlocked with said trigger.

6. The hair treatment appliance of claim 1, wherein said comb means further includes a brush means removably secured thereto.

7. A hair treatment appliance comprising:

an elongated body having a hollow chamber, said elongated body having a proximal and distal end, said body having a pair of oppositely positioned openings near said proximal end;

trigger means moving along said body, a portion of said trigger means extending outwardly through a first of said pair of openings in said body;

an aerosol container disposed in said chamber, said container having a dispensing valve engageable with said trigger means, said valve being directed towards a second of said pair of openings in said body to expel an aerosol spray through said second opening when said trigger means is depressed;

a closure cap securable at said distal end of said body;

means for securing said trigger means within said first of said pair of openings in said body and for preventing said trigger means from pivoting when said trigger means is depressed;

means for preventing said valve from turning when said trigger means is depressed, said means for preventing comprising a protrusion on an underside surface of said trigger, said protrusion having a proximal and distal end, said protrusion having a nub at said distal end, said means for preventing further comprising a groove in an upper surface of said dispensing valve, said groove having a proximal and distal end, said groove having a recess at its distal end, said protrusion and said groove being correspondingly shaped such that when said aerosol container is placed within said chamber, said dispensing valve is interlocked with said trigger; and comb means secured to said proximal end of said elongated body and extending outwardly therefrom.

8. The hair treatment appliance of claim 7, wherein said closure cap further includes a plurality of elongated hair lifter elements secured thereto and extending outwardly therefrom in a generally parallel arrangement to said comb means.

9. The hair treatment appliance of claim 7, further including at least one flange member depending outwardly from and substantially perpendicular to said trigger means.

10. The hair treatment appliance of claim 9, wherein said means for securing is at least one slot in said body at said first opening, wherein said flange member is received within said slot to secure said trigger means within said first opening, said slot and said flange member preventing said trigger means from pivoting around said valve.

11. The hair treatment appliance of claim 7, wherein said comb means further includes a brush means removably secured thereto.

12. A hair treatment appliance comprising:

an elongated body having a hollow chamber, said elongated body having a proximal and distal end, said body having a pair of oppositely positioned openings near said proximal end;

trigger means moving along said body, a portion of said trigger means extending outwardly through a first of said pair of openings in said body;

an aerosol container disposed in said chamber, said container having a dispensing valve engageable with said trigger means, said valve being directed towards a second of said pair of openings in said body to expel an aerosol spray through said second opening when said trigger means is depressed;

a closure cap securable at said distal end of said body, said closure cap having means for providing lateral support to said aerosol container;

means for securing said trigger means within said first of said pair of openings in said body and for preventing said trigger means from pivoting when said trigger means is depressed;

means for preventing said valve from turning when said trigger means is depressed, said means for preventing comprising a protrusion on an underside surface of said trigger, said protrusion having a proximal and distal end, said protrusion having a nub at said distal end, said means for preventing further comprising a groove in an upper surface of said dispensing valve, said groove having a proximal and distal end, said groove having a recess at its distal end, said protrusion and said groove being correspondingly shaped such that when said aerosol container is placed within said chamber, said dispensing valve is interlocked with said trigger; and comb means secured to said proximal end of said elongated body and extending outwardly therefrom.

13. The hair treatment appliance of claim 12, wherein said closure cap further includes a plurality of elongated hair lifter elements secured thereto and extending outwardly therefrom in a generally parallel arrangement to said comb means.

14. The hair treatment appliance of claim 12, further including at least one flange member depending outwardly from and substantially perpendicular to said trigger means.

15. The hair treatment appliance of claim 14 wherein said means for securing is at least one slot in said body at said first opening, wherein said flange member is received within said slot to secure said trigger means within said first opening, said slot and said flange member preventing said trigger means from pivoting around said valve.

16. The hair treatment appliance of claim 12, wherein said comb means further includes a brush means removably secured thereto.

* * * * *